US006604965B2

(12) United States Patent
Beideman

(10) Patent No.: US 6,604,965 B2
(45) **Date of Patent: *Aug. 12, 2003**

(54) SAFETY ENHANCEMENT DEVICE FOR ELECTRICAL APPARATUS

(75) Inventor: Gary S. Beideman, West Chester, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/135,054

(22) Filed: Apr. 29, 2002

(65) Prior Publication Data

US 2002/0119703 A1 Aug. 29, 2002

Related U.S. Application Data

(63) Continuation of application No. 09/689,977, filed on Oct. 13, 2000, now Pat. No. 6,394,848.

(51) Int. Cl.[7] ..... H01R 13/68

(52) U.S. Cl. ..... 439/622; 439/606

(58) Field of Search ..... 439/622, 411, 439/621, 412, 417; 337/186, 187, 198; 200/11, 361, 46

(56) References Cited

U.S. PATENT DOCUMENTS

| | | | | | |
|---|---|---|---|---|---|
| 4,208,645 | A | | 6/1980 | Harmon et al. | |
| 4,646,052 | A | * | 2/1987 | Matsunaga et al. | 337/166 |
| 5,229,739 | A | * | 7/1993 | Oh et al. | 337/290 |
| 5,249,986 | A | | 10/1993 | Lu | |
| 5,424,895 | A | | 6/1995 | Gaston | |
| 5,814,775 | A | | 9/1998 | Chou | |
| 5,876,250 | A | | 3/1999 | Deng | |
| 5,924,888 | A | | 7/1999 | Larkin | |
| 6,394,848 | B1 | * | 5/2002 | Beideman | 439/622 |

* cited by examiner

*Primary Examiner*—P. Austin Bradley
*Assistant Examiner*—Phuongchi Nguyen
(74) *Attorney, Agent, or Firm*—RatnerPrestia

(57) ABSTRACT

An enhanced safety device combination for electrical apparatus or appliances which includes a thermal responsive cut-off in the apparatus, and a non-replaceable fuse in the electrical cordset plug.

23 Claims, 4 Drawing Sheets

FUSED PLUG DETAIL
FUSED PLUG
HOT IN (SMOOTH WIRE)
NEUTRAL (RIBBED WIRE)
CORDSET (SMOOTH WIRE)
CORDSET (RIBBED WIRE)
ROTORY SWITCH (3 SPEED) (VIEW FROM TOP)
SPLICE
4 uF 250 WVAC
WHITE
BLACK
BROWN
RED
ELECTRICAL SCHEMATIC
THERMAL CUTOFF
CAP
HIGH
MED
LOW
OFF

SAFETY ENHANCEMENT DEVICE FOR ELECTRICAL APPARATUS

This application is a Continuation of U.S. Pat. No. 6,394,848B1, Ser. No. 09/689,977, filed Oct. 13, 2000.

BACKGROUND OF THE INVENTION

1. Field of the Invention

This invention relates to a safety enhancement device combination for electrical apparatus or appliances of the type which has a thermal cut-off device in the apparatus, and a non-replaceable fuse in the cordset plug of the apparatus or appliance.

2. Description of the Prior Art

Air moving apparatus, appliances with a motor, or with electric heating elements are potentially subject to electrical problems due to accident, misuse, excessive moisture and/or heat, which can cause the wiring in a motor, or the cordset or other wires to short. Motors in appliances often incorporate a thermal cut-off device which reacts to heat increase to shut off the motor. Thermal devices are generally slow acting and designed to sense and react to a gradual heat increase. The heat increase can be caused by a variety of factors such as a slow acting shorting in the motor windings, or bearing failures which would cause air flow across the windings to cease, which causes the windings to heat up.

Thermal devices are most effective at sensing localized heating, such that if a failure occurs at a location remote from the thermal device, the thermal device may not sense the condition, quickly enough to shut the motor down prior to failure.

Rapidly acting remote failures may delay the thermal device operation and damage to the device may result.

A fuse will react to rapid failure conditions, and current increase over its capacity, and will protect components upstream from the motor, such as the cordset. A fuse will also react to foreseeable shorts internal to the switch, lead wires, and motor windings.

A fuse, to be effective, must be non-replaceable in order to insure that the user does not defeat the purpose of the fuse, which is to enhance safety of the thermal fuse thus preventing damage to components or the apparatus or appliance. The combination of these two devices in an electrical apparatus or appliance will enhance the safety of the apparatus or appliance as well as act to protect its components.

SUMMARY OF THE INVENTION

This invention relates to a safety enhancement device combination for an electrical apparatus or appliance which includes a thermal cut-off device in the apparatus and a non-replaceable fuse in the cordset plug.

The principal object of the invention is to provide an enhanced safety device combination to protect electrical apparatus or appliances from damage due to excessive heat or shorts.

A further object of the invention is to provide an enhanced safety device combination as aforesaid that is fast and positive in operation.

A further object of the invention is to provide an enhanced safety device combination as aforesaid that is useful with a wide variety of electrical apparatus or appliances, wherein the appliances may have inductive, capacitive or tungsten type loads. The fuse portion of the enhanced safety device can be matched to the load type by current value and trip characteristics. Inductive loads where in rush currents start low may use a fast trip fuse. Tungsten and capacitive loads with higher in rush currents may be designed with a slow blow.

A further object of the invention is to provide a reliably manufacturable assembly. The high injection pressures involved with molding plastic around the plug assembly can move the component parts, and potentially create an intermittent or open connection. Component parts are encapsulated with a cap and cover preventing the invasion of plastic during the molding operation.

A further object of the invention is to provide an enhanced safety device which is no larger than devices typically found in the marketplace, although containing an additional fuse. This is achieved by locating the device components in slots and cavities integral to the cap.

A further object of the invention is to provide an enhanced safety device combination as aforesaid that is reliable and inexpensive to construct.

A further object of the invention is to provide an enhanced safety device combination as aforesaid that enhances the safety of the apparatus or appliance. Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

The entire disclosure of U.S. Pat. No. 6,394,848B1 filed Oct. 13, 2000 is expressly incorporated by reference herein.

When referring to the preferred embodiment, certain terminology will be utilized for the sake of clarity. Use of such terminology is intended to encompass not only the described embodiment, but also technical equivalents which operate and function in substantially the same way to bring about the same result.

Figures 1, 2, 3:
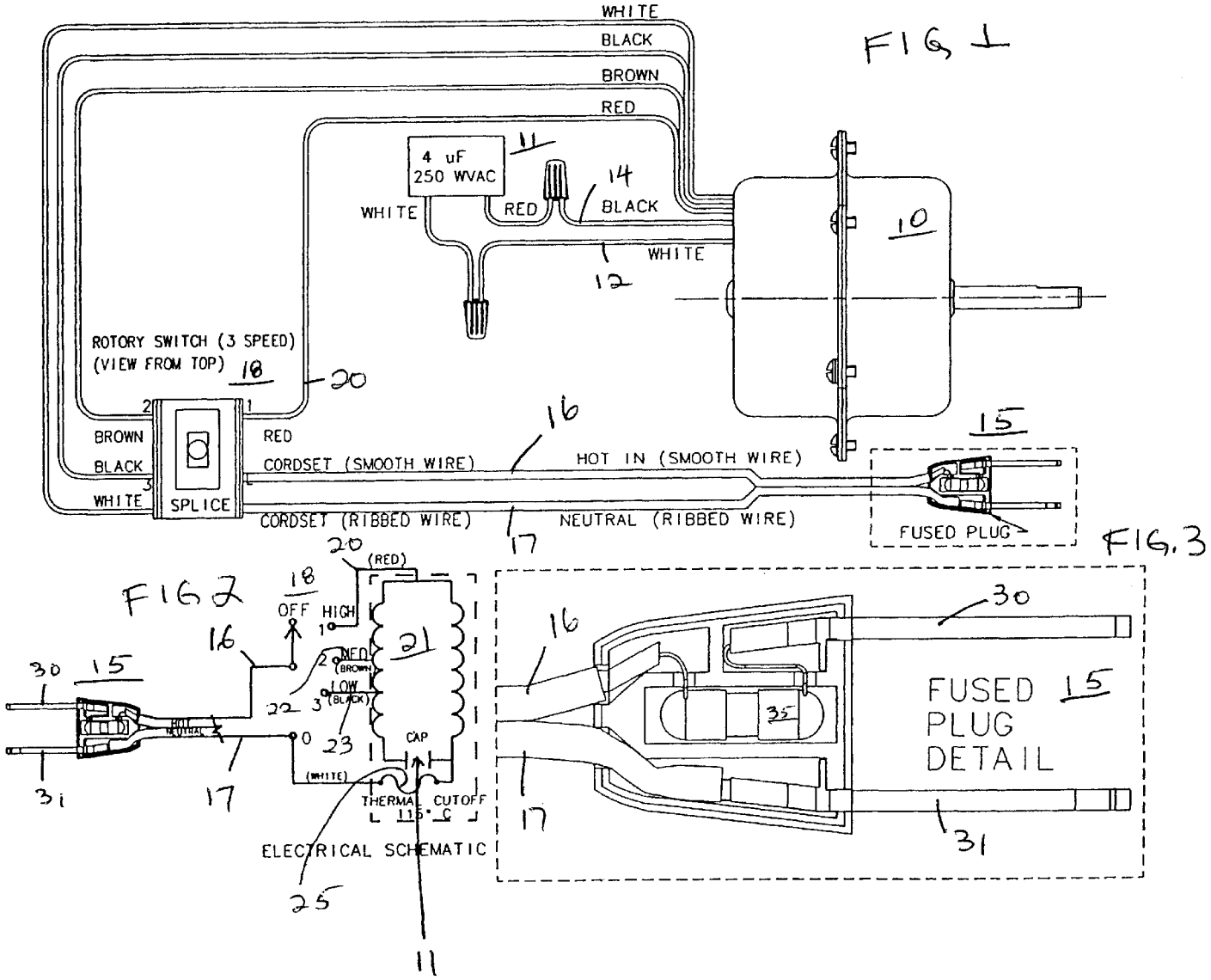
FIG. 1 is a schematic of the safety device combination of the invention as installed in an electrical apparatus having an electric motor.
FIG. 2 is a schematic of the apparatus of FIG. 1 but showing the internal wiring of the motor.
FIG. 3 is a plan view of the detail of the cordset plug.
Figure 4:
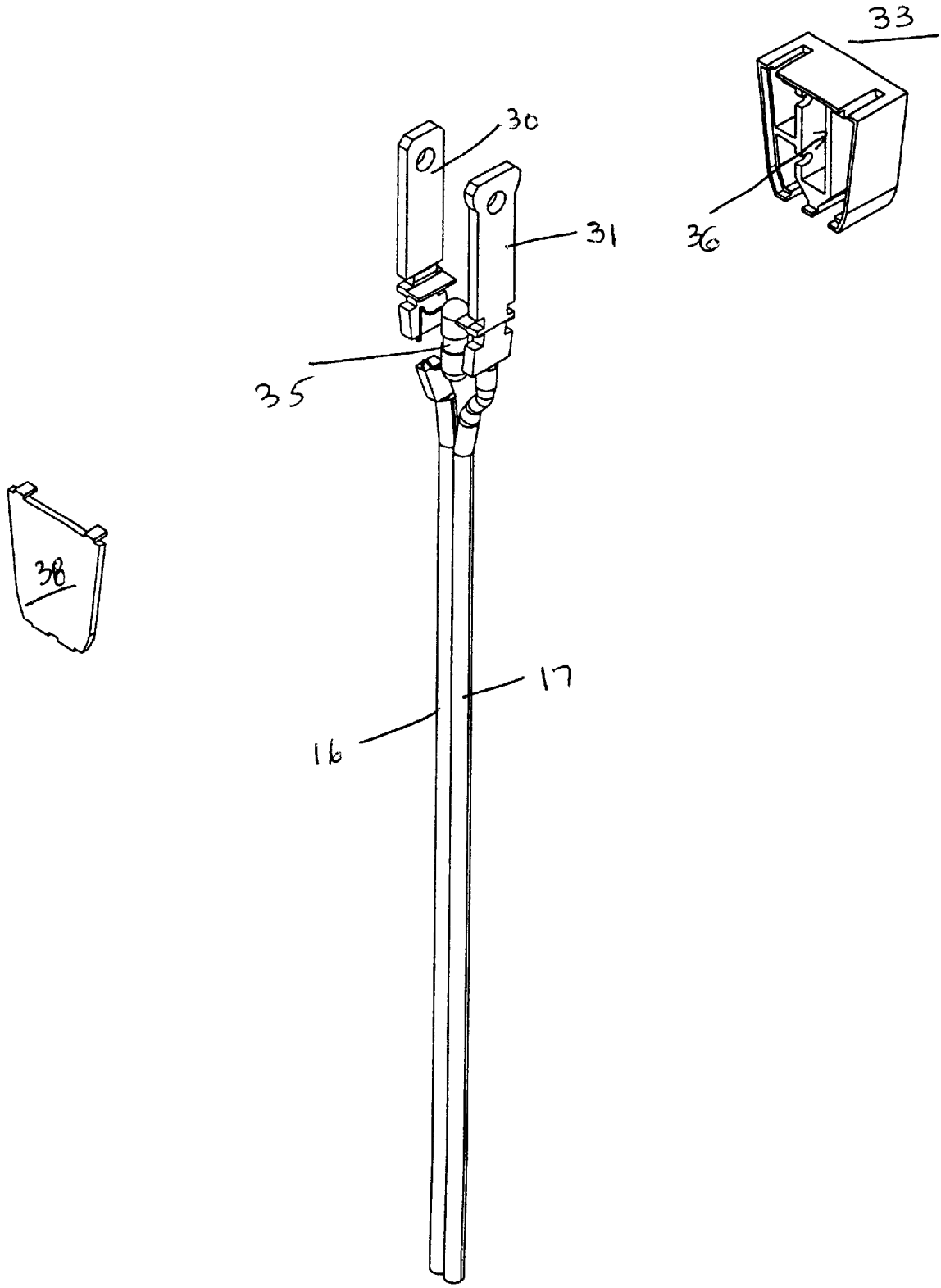
FIG. 4 is an exploded perspective view of the cordset plug.
Figure 5:
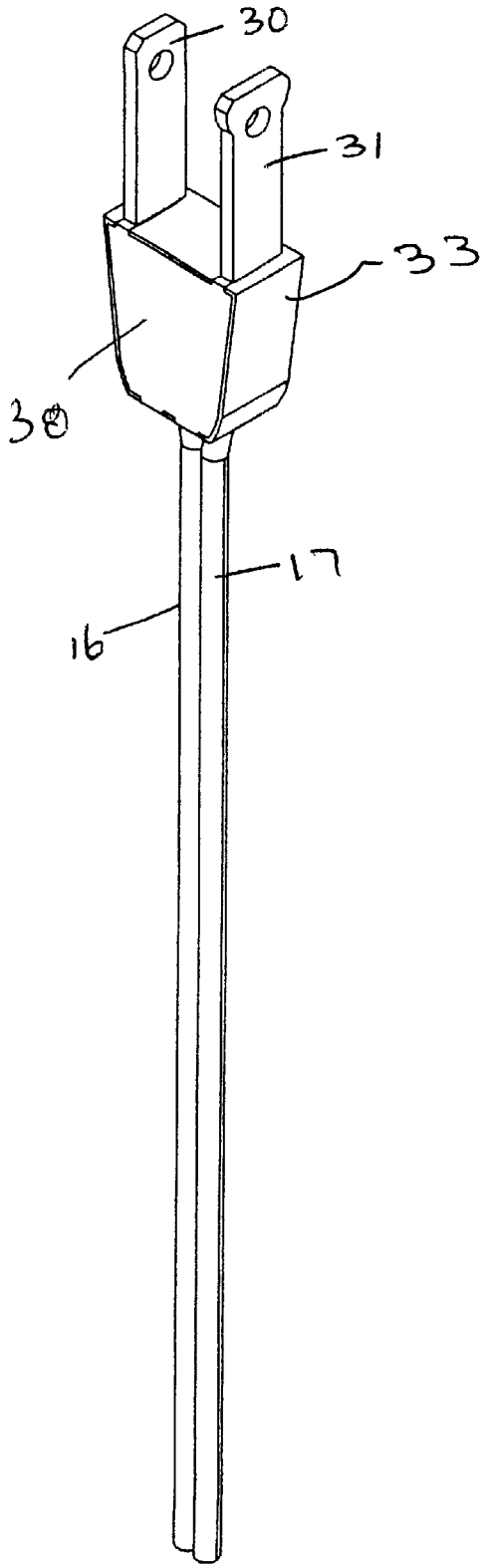
FIG. 5 is a perspective view in partially assembled condition of the cordset plug.

Referring now more particularly to FIGS. 1, 2 of the drawings one embodiment of the enhanced safety device combination is therein illustrated, as used with an electric motor 10 of well known type.

The motor 10 has a capacitor 11 of well known type in series therewith and connected thereto by wires 12 and 14.

A cordset plug 15 is provided to be connected to a source of electrical energy (not shown) and has a hot or positive wire 16 and a neutral wire 17 connected thereto, and to a multi-position rotary switch 18 of well known type, illustrated as a three speed switch which may or may not be included in the device. The switch 18 has a high speed wire 20 connected thereto and to the motor windings 21, a medium speed wire 22 connected thereto and to motor windings 21, and a low speed wire 23 connected thereto and to motor windings 21.

The neutral wire 17 is also connected from switch 18 to the motor windings 21 through a thermal cut-off device 25 of well known type.

The thermal cut-off device 25 as illustrated will be activated by a temperature rise, and will open the circuit to cut off the motor 10, and may be of the single use or reset type as desired.

Figure 6:
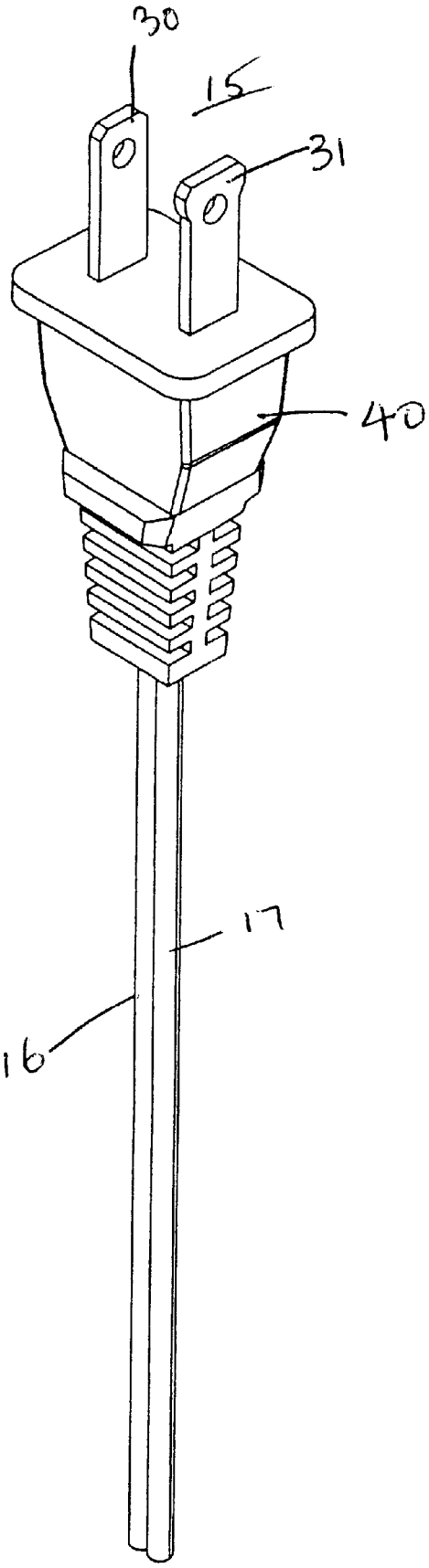
FIG. 6 is a perspective view of the molded cordset plug assembly.

Referring now additionally to FIGS. 3–6 the cordset plug 15 includes two spades 30 and 31 of well known type, with spade 31 connected to neutral wire 17 and engaged in recess 32 of a plug cover 33. The cover 33 is preferably of molded plastic and open at one side. The spade 30 is engaged in recess 36 of cover 33 and connected to a fuse 35 of well known type, which fuse 35 is rated at the desired current capacity and engaged in recess 36 of cover 33, and connected to hot wire 16. A cap 38 is provided which snaps into cover 33, and connected to hot wire 16. A cap 38 is provided which snaps into cover 33, which as shown in FIG. 6 is covered with a continuous layer 40 of plastic, 10 preferably plastic applied in a mold (not shown) which encapsulates cover 33 and cap 38, making the fuse 35 inaccessible to the consumer.

The mode of operation will now be pointed out. In use the cordset plug 15 is connected to a source of electrical energy (not shown) and when desired the apparatus is energized by rotating switch 18 and motor 10 is activated. Should the motor windings 21 overheat in a foreseeable manner, the thermal cut-off device 25 will be activated and the motor 10 will be shut down.

Should there be a foreseeable failure of the system remote from the thermal cutoff device, the current will rise rapidly, fuse 35 will blow and the current flow through wire 16 will be broken thereby shutting down motor 10.

While the combination is illustrated as used with an electric motor it can be used with other electrical apparatus such as an air moving device, a heater, or an appliance where protection is desired. It will thus be apparent that the objects of the invention have been achieved.

I claim:

1. An electrical plug for use with a cordset, the plug comprising:

a plug cover having an opening on one side, a cap coupled to the cover to close off the opening, a fuse in the cover, said fuse connected to a wire of the cordset, at least two terminals in the cover, a first one of the terminals connected to the fuse, and a second one of the terminals connected to a wire of the cordset, and an outer layer of plastic molded over and encapsulating the cover and the cap to prevent access to the fuse.

2. The plug according to claim 1, wherein the fuse is a slow blow fuse.

3. The plug according to claim 1, wherein the fuse is a fast trip fuse.

4. The electrical plug according to claim 1, wherein the fuse is non-replaceable.

5. The plug according to claim 1, wherein the cordset is connected to a switch means.

6. The plug according to claim 5, further comprising second wires connecting the switch means to an apparatus or appliance.

7. The plug according to claim 1, wherein the cordset has at least a neutral wire and a positive wire, the plug being coupled to the wires.

8. The plug according to claim 7, wherein the fuse is connected in series with one of the wires.

9. The plug according to claim 8, wherein the fuse is connected in series with the positive wire.

10. The plug according to claim 1, wherein the cordset is connected to an apparatus or appliance.

11. The plug according to claim 10, wherein the apparatus or appliance represents an inductive load.

12. The plug according to claim 10, wherein the apparatus or appliance represents a capacitive load.

13. The plug according to claim 10, wherein the apparatus or appliance represents a tungsten load.

14. The plug according to claim 10, further comprising a thermal cut-off device within the apparatus or appliance in series with the cordset and the apparatus or appliance.

15. The plug according to claim 14, wherein the thermal cut-off device senses a temperature of the apparatus or appliance and interrupts current flow to the apparatus or appliance responsive to a temperature rise event.

16. An electrical plug for use with an apparatus having an electrical cord, the plug comprising:

a plug cover having an opening on one side, a cap coupled to the cover to close off the opening, a non-replaceable fuse in the cover, said fuse connected to a wire of the electrical cord, at least two terminals in the cover, a first one of the terminals connected to the fuse, and a second one of the terminals connected to a wire of the electrical cord, and an outer layer of plastic molded over and encapsulating the cover and the cap to prevent access to the fuse.

17. The plug according to claim 16, further comprising a thermal cut-off device in series with the cord and the apparatus.

18. The plug according to claim 17, wherein the thermal cut-off device senses a temperature of the apparatus and interrupts current flow to the apparatus responsive to a temperature rise event.

19. The plug according to claim 16, wherein the cord has at least a neutral wire and a positive wire, and wherein the plug is coupled to the wires.

20. The plug according to claim 19, wherein the non-replaceable fuse is connected in series with the positive wire.

21. An electrical plug comprising:

a plug cover having an opening, a cap coupled to the cover to close off the opening, a fuse in the cover, at least two terminals in the cover, a first one of the terminals connected to the fuse, and an outer layer of plastic molded over and encapsulating the cover and the cap to prevent access to the fuse.

22. The electrical plug according to claim 21, wherein the opening is on one side of the plug cover.

23. The electrical plug according to claim 21, wherein the fuse is non-replaceable.

* * * * *